US006012277A

United States Patent [19]

Prins et al.

[11] Patent Number: 6,012,277

[45] Date of Patent: Jan. 11, 2000

[54] YARN SPINNING FROM FIBRE SUB-ASSEMBLIES WITH VARIATION OF THEIR PATHS OF TRAVEL, RELATIVE POSITIONS OR TWIST LEVELS

[75] Inventors: Martin Willem Prins, Barwon Heads; Peter Ronald Lamb, Belmont; Geoffrey Robert Stewart Naylor, Ocean Grove, all of Australia; Xiaoming Tao, Kowloon, The Hong Kong Special Administrative Region of the People's Republic of China

[73] Assignee: Commonwealth Scientific & Industrial Research Organisation, Australian Capital Territory, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/647,971

[22] PCT Filed: Nov. 22, 1994

[86] PCT No.: PCT/AU94/00719

§ 371 Date: Jul. 29, 1996

§ 102(e) Date: Jul. 29, 1996

[87] PCT Pub. No.: WO95/14800

PCT Pub. Date: Jun. 1, 1995

[30] Foreign Application Priority Data

| | | | |
|---|---|---|---|
| Nov. 23, 1993 | [AU] | Australia | PM2604 |
| Aug. 30, 1994 | [AU] | Australia | PM7771 |
| Oct. 24, 1994 | [AU] | Australia | PM8987 |

[51] Int. Cl.[7] ..... D01H 5/28

[52] U.S. Cl. ..... 57/315; 19/237; 19/243; 19/258; 19/287; 19/288; 57/2; 57/317; 57/319; 57/326

[58] Field of Search ..... 57/252, 2, 315, 57/317, 318, 319, 324, 325, 326, 75; 19/237, 243, 258, 287, 288, 151, 152

[56] References Cited

U.S. PATENT DOCUMENTS

| | | | |
|---|---|---|---|
| 2,358,656 | 9/1944 | Nutter et al. | 57/315 |
| 2,925,628 | 2/1960 | Boer | 19/258 |
| 3,105,997 | 10/1963 | Mackie | 19/243 |
| 3,599,416 | 8/1971 | Reuter et al. | 57/315 |
| 3,851,698 | 12/1974 | Leach et al. | 57/91 |
| 4,418,523 | 12/1983 | Lemaire | 57/207 |
| 4,662,164 | 5/1987 | Morrison | 57/315 |
| 5,084,941 | 2/1992 | Brockmanns et al. | 19/151 |
| 5,090,192 | 2/1992 | Stahlecker | 57/315 |
| 5,228,281 | 7/1993 | Stahlecker | 57/315 |
| 5,431,005 | 7/1995 | Fehrer | 57/315 |

FOREIGN PATENT DOCUMENTS

| | | | |
|---|---|---|---|
| 438072 | 7/1973 | Australia . | |
| 473153 | 5/1976 | Australia . | |
| B 81889/75 | 12/1976 | Australia . | |
| 870 948 | 4/1979 | Belgium . | |
| 411 379 | 2/1991 | European Pat. Off. . | |
| 57-029615 | 2/1982 | Japan . | |
| 4-153329 | 5/1992 | Japan | 19/258 |
| 1142539 | 2/1985 | U.S.S.R. | 57/279 |
| 1286646 | 1/1987 | U.S.S.R. | 19/258 |
| WO 94/01604 | 12/1983 | WIPO . | |

OTHER PUBLICATIONS

Effect of Volume Fraction of Each Fleece . . . Spun Yarn, vol. 43, No. 11 (1990) pp. T98–T104.

Structural Effects of Spun Yarns on Wear Resistance, vol. 41, No. 12 (1988) pp. T177–T183.

Geometrical Principles Applicable . . . Functional Fabrics, vol. XVII, No. 3, Mar, 1947, pp. 123–147.

The Arrangement of Fibres in Fibro Yarns, pp. T60–T66.

The Arrangement of Fibers in Single Yarns, vol. XXVI, No. 5, May 1956, pp. 325–331.

An Alternative Approach to Two–Fold . . . Surface Fibres, vol. 73, No. 3, May/Jun. 1982, pp. 99, 106.

An Alternate Approach to Two–Fold . . . Yarns, J. Text Inst., 1983, No. 6, pp. 320–328.

Influence Exerted by the Spinning . . . Fiber Yarns, Melliand Textilberichte, Aug. 1985, pp. 605–610.

*Primary Examiner*—William Stryjewski

*Attorney, Agent, or Firm*—Knobbe, Martens, Olson & Bear, LLP

[57] ABSTRACT

A yarn is spun by dividing a traveling fiber assembly into a plurality of fiber sub-assemblies, causing the sub-assemblies to traverse different paths and then recombining them, wherein the paths are sufficiently proximate for fibers to continuously transfer from one or more of the sub-assemblies and be drawn onto or into another or other sub-assemblies. Also disclosed is a method for forming a yarn comprising twisting a plurality of fiber sub-assemblies together at a convergence point to form a fiber assembly being a yarn, and further including cyclically altering the relative twist propagation in and/or into the sub-assemblies upstream of the convergence point. Still further disclosed are alternative methods involving cyclic variation of paths traversed by the sub-assemblies, and cyclic alteration of the relative positions of the sub-assemblies. Apparatus is described for carrying out each method.

68 Claims, 12 Drawing Sheets

FIG 5
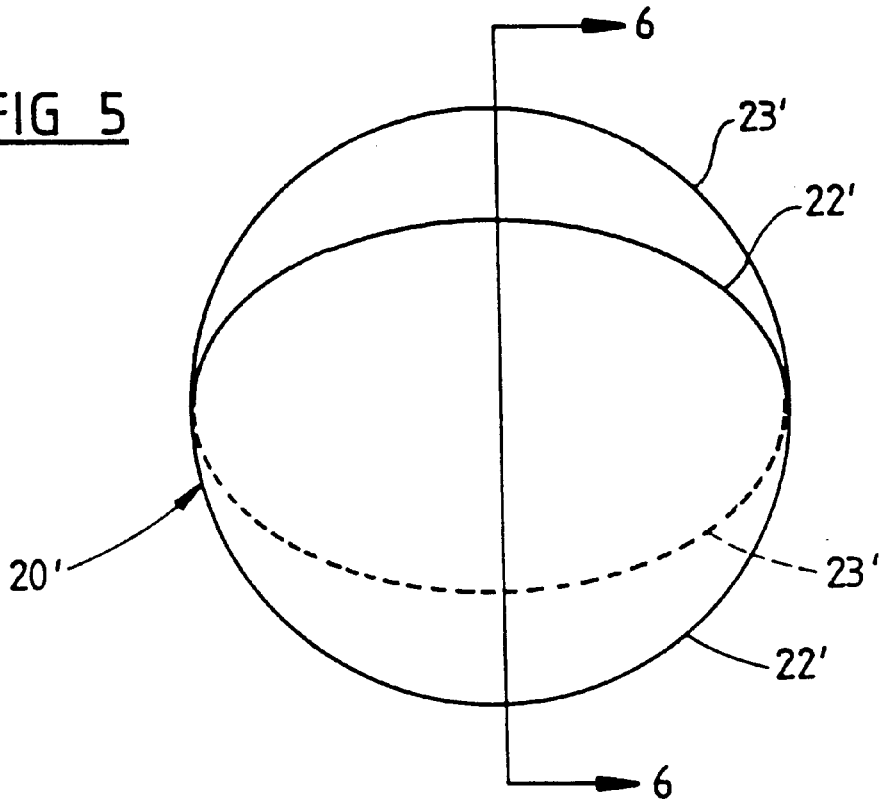
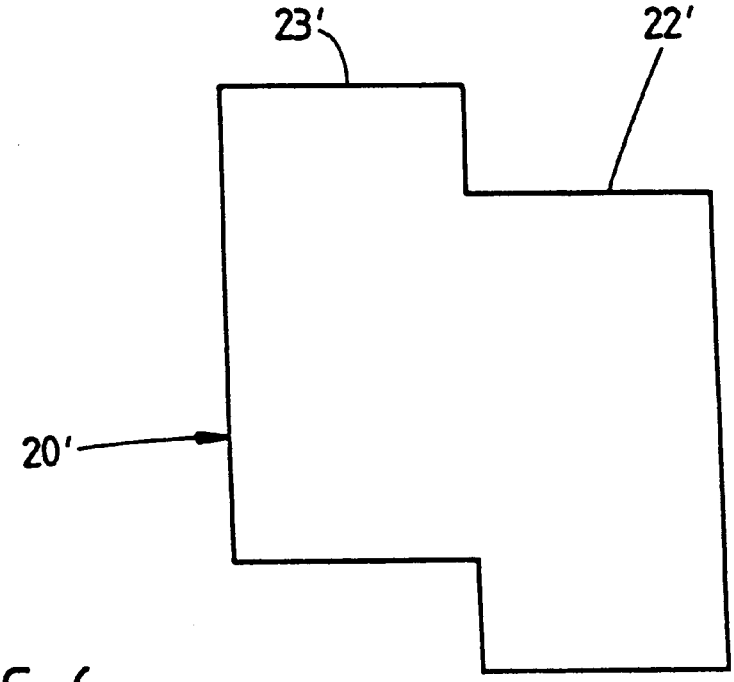
FIG 6

YARN SPINNING FROM FIBRE SUB-ASSEMBLIES WITH VARIATION OF THEIR PATHS OF TRAVEL, RELATIVE POSITIONS OR TWIST LEVELS

FIELD OF THE INVENTION

This invention relates generally to the processing of fibre assemblies. A particularly useful application is to the spinning of yarns, especially though not exclusively staple yarns, and in preferred aspects the invention provides a weavable or low pilling yarn from single or double rovings or slubbings.

BACKGROUND ART

Two-strand yarns may be produced by spinning or twisting together two strands in which the fibre tails have been wrapped by an air-jet (eg Plyfil) or in which the alternating strand twist is trapped during the operation (eg Sirospun). Such yarns have enhanced strength and abrasion resistance relative to singles yarns but in worsted processing have an average cross-section of around 80 or more fibres. It would be very useful to produce a weavable singles yarn of a structure which may be of significantly smaller cross-section, with say around 50–60 fibres or less. However, singles yarns of such size to date have tended to have inadequate strength and abrasion resistance for weaving and knitting applications.

It was recognized by Peirce [Peirce, F. T.; Textile Research Journal, 1947, 17, p123], Morton and Yen [Morton, W. E. and Yen, K. C. J.; Journal of the Textile Institute, 1952, 22, T.463], and Morton [Morton, W. E.; Annales Scientifiques Textiles Belges, 1956, p29], that fibre migration, or entanglement, must occur during twist insertion to give the resulting yarn strength and abrasion resistance. In relation to the fibre strand emerging from the front roller nip, Morton stated in part that " . . . since the length of the fibre path increases from the core to the surface, so also must the tension in the fibres. At any given instant, those forming the outer layer of the yarn follow the longest path and are conseqently highly stressed; and furthermore the curvature of their path is also the largest" It has been shown by the above authors that these highly stressed fibres will tend to migrate toward the axis of the yarn in order to achieve a lower tension condition. However, " . . . as soon as the trailing end of the fibre emerges from the nip of the front rollers, tension in the fibre must drop to zero. It is then in no condition to do other than suffer expulsion to the surface, where it will appear as (a) projecting fibre." In his concluding remarks, Morton states, "A further practical outcome is that, since wild, or wildish fibres, (we must recognise that there are degrees of wildness) are unlikely to contribute their fair share to the strength of the yarn, the width of the ribbon of drawn-out roving should be limited as much as possible".

International patent publication WO94/01604 (PCT/NZ93/00055) by Wool Research Organization of New Zealand discloses a number of practical techniques for applying the above concepts to a single drafted assembly or strand of fibres as the strand is spun from a drafting system. In one of these techniques, a guide oscillates the strand laterally so as to cyclically vary the tension in the fibres of the strand. By varying the tension in this way, the fibres are caused to migrate cyclically between the core and the surface of the resultant yarn. In another arrangement, the drafted strand is passed through an additional pair of nip rollers located immediately downstream of the front drafting rollers. The nip rollers are driven at a lower speed than the delivery speed of the front drafting rollers, a negative draft which induces an "overfeed" zone in which the fibres are found to randomly alter their positions at the nip. There is thus a random migration of the fibres between the core and the surface of the yarn. In a third arrangement, the drafted strand is allowed to spread sufficiently laterally for "sub-groupings" to form in which the fibres are false twisted to form separate sub-strands that are then twisted together in a recombined yarn.

The proposal in WO94/01604 for guide oscillation has some similarities to various proposals for forming two-strand yarns from a pair of separate strands, disclosed or discussed eg in U.S. Pat. No. 3,599,416, in Australian patents 438072 and 473153, and in D. Plate et al, J. Text. Inst. 73 (No. 3, 1982), p. 99, and 74 (No. 6, 1983), p. 320. This class of two-strand spinning processes embraces, inter alia, the present applicant's technology known as the "Sirospun" process. The possible existence of pre-twisting of small fibre sub-groupings in the twist triangle of two-strand spinning systems is discussed in Neckar et al, Melliand Textilberichte [English edition], August, 1985, p. 605.

Harakawa et al (J. Text. Machinery Soc. Japan, 43 (No. 11, 1990), T98 and 41 (1988), T(177) propose a device in which the strand emerging from the front rollers is drawn down to a hollow spindle which can be oscillated laterally. The yarns so produced have different fibres on the outside according to the side from which they emerged and the position of the hollow spindle. A corresponding disclosure is to be found in Japanese patent publication 57-029615.

U.S. Pat. No. 4,418,523 disclosed a notched roller for providing fancy yarns in spinning-twisting machines, where the core is false-twisted and wrapped with a filament.

DISCLOSURE OF THE INVENTION

It is accordingly an object of the invention, at least in one or more of its advantageous applications, to provide a spinning method and apparatus which is capable of producing a fibre yarn having a useful level of yarn strength and/or abrasion resistance relative to the average number of fibres in the yarn cross-section. The yarn may be a singles yarn or otherwise but an object of one or more embodiments of the invention is to produce a singles yarn having the above property.

In a first aspect of the invention, there is provided a method of spinning a yarn comprising dividing a travelling fibre assembly into a plurality of fibre sub-assemblies, causing the sub-assemblies to traverse different paths and then recombining them, wherein said paths are sufficiently proximate for fibres to continuously transfer from one or more of said sub-assemblies and be drawn onto or into another or other sub-assemblies.

The invention also provides, in its first aspect, apparatus for spinning a yarn comprising:

- drafting means for receiving and drafting a travelling fibre assembly;
- take-up means for drawing and taking up the fibre assembly from said drafting means;
- means to divide the travelling fibre assembly into a plurality of fibre sub-assemblies downstream of said drafting means and to cause said sub-assemblies to traverse different paths; and
- means to recombine said fibre sub-assemblies to form said yarn; wherein said paths are sufficiently proximate for fibres to continuously transfer from one or more of said sub-assemblies and be drawn onto or into another or other sub-assemblies.

Preferably, in the first aspect of the invention, the recombining means is effective to twist the sub-assemblies together. More preferably, the twist travels further back along said one of said fibre sub-assemblies, past the point of recombination, than for another fibre sub-assembly. Advantageously, this is effective to cause the fibre sub-assemblies to have different path lengths by which fibres transferring between sub-assemblies have different axial tensions.

In a second aspect of the invention, there is provided a method of spinning a yarn comprising causing a plurality of fibre sub-assemblies to traverse cyclically varying paths and then combining them to form a fiber assembly comprising a yarn by twisting the sub-assemblies together.

In its second aspect, the method further includes dividing an initial travelling fibre assembly into said plurality of fibre sub-assemblies.

The invention also provides, in its second aspect, apparatus for spinning a yarn comprising:

take-up means for drawing and taking up a plurality of fibre sub-assemblies;

means to cause said sub-assemblies to traverse cyclically varying paths; and means to combine said fibre sub-assemblies to form a fibre assembly comprising a yarn by twisting the sub-assemblies together.

The apparatus of the second aspect may further include means to divide an initial travelling assembly into the aforesaid plurality of fibre sub-assemblies. The apparatus may also include drafting means for receiving and drafting said initial travelling fibre assembly, which dividing means is disposed downstream of the drafting means.

In this second aspect, cyclic variation of the paths may comprise cyclically altering the relative lengths of the paths traversed by the sub-assemblies between their division from the fibre assembly and their twisting together.

In a third aspect, the invention provides a method of spinning a yarn comprising dividing a travelling fibre assembly into a plurality of fibre sub-assemblies, forming said yarn by twisting said sub-assemblies together, and further including cyclically altering the relative positions of the sub-assemblies between their division from the fibre-assembly and their twisting together.

In the third aspect, the invention also provides apparatus for spinning a staple yarn comprising:

drafting means for receiving and drafting a travelling staple fibre assembly;

take-up means for drawing and taking up the fibre assembly from said drafting means;

means to divide the travelling fibre assembly into a plurality of fibre sub-assemblies downstream of said drafting means;

twisting means to twist the sub-assemblies together to form said yarn; and means to cyclically alter the relative positions of the sub-assemblies between their division from the fibre-assembly and their twisting together.

In a preferred embodinent, the paths traversed by the respective sub-assemblies are cyclically varied by braiding means for cyclically interchanging the relative lateral positions of the sub-assemblies, for example, by laying each sub-assembly across another sub-assembly and then returning the former to its original relative lateral position. The braiding means is preferably effective to enhance the intermingling of fibres between the sub-assemblies.

Advantageously, in this embodiment, the braiding is controlled according to a pre-determined sequence along the length of the moving fibre assembly selected to optimise fibre interactions.

Preferably, in this embodiment, the braiding means is effective to create an intertwined ibre network prior to the insertion of twist. Such a network will in general be quite distinct from the internal fibre structure which might be obtained by simply twisting randomly appearing sub-groupings, as proposed in the aforementioned WO94/01604.

In a simple arrangement, the braiding means also serves as said means for dividing the travelling fibre assembly into the plurality of sub-assemblies. Such means may comprise a rotatable roller structure having respective different helical grooves to effect the cyclic variation of the paths traversed by the sub-assemblies and/or their relative positions.

More generally, in all of the aforementioned aspects of the invention, the means to divide the travelling fibre assembly may comprise a rotatable roller structure having respective lands of different displacements and/or radii with reference to an axis of rotation. The rotatable roller structure may be arranged to cause the cyclic variation of the path lengths traversed by the sub-assemblies.

In a fourth aspect, the invention provides a method for forming a yarn comprising twisting a plurality of fibre sub-assemblies together at a convergence point to form a fibre assembly being a yarn, and further including cyclically altering the relative twist propagation in and/or into the sub-assemblies upstream of the convergence point, for example by cyclically altering one or more of the distance between last surface contact or nip point of the sub-assemblies and their convergence, the relative positions of the sub-assemblies, or the path length of the sub-assemblies before their convergence. In this fourth aspect, the invention also provides apparatus for carrying out the method. Means to cyclically alter the relative twist propagation may comprise a rotatable roller stucture having respective lands of different displacements and/or radii with reference to an axis of rotation.

In an application of the invention in its second, third or fourth aspect, there may be three or more fibre sub-assemblies and the relative twist propagation or relative paths may be cyclically altered so as to produce a yarn structure in which each fibre sub-assembly is trapped between another two of the fibre sub-assemblies at spaced intervals along the yarn. Such a technique may be viewed as a form of "false-braiding". The spaced intervals are preferably such that the majority of fibres in the yarn are subject to a plurality of trapping points along the length of the respective fibre. The aforementioned rotatable roller structure may be adapted to carry out the technique.

The fibre-assemblies in the respective aspects of the invention are preferably staple fibre-assemblies, natural or man-made.

BRIEF DESCRIPTION OF THE DRAWINGS

The invention will now be further described, by way of example only, with reference to the accompanying drawings, in which:

FIGS. 5 and 6 are side and sectional views, respectively, of a further alternative form of splitting roller;

EMBODIMENTS OF THE INVENTION

Figure 1:
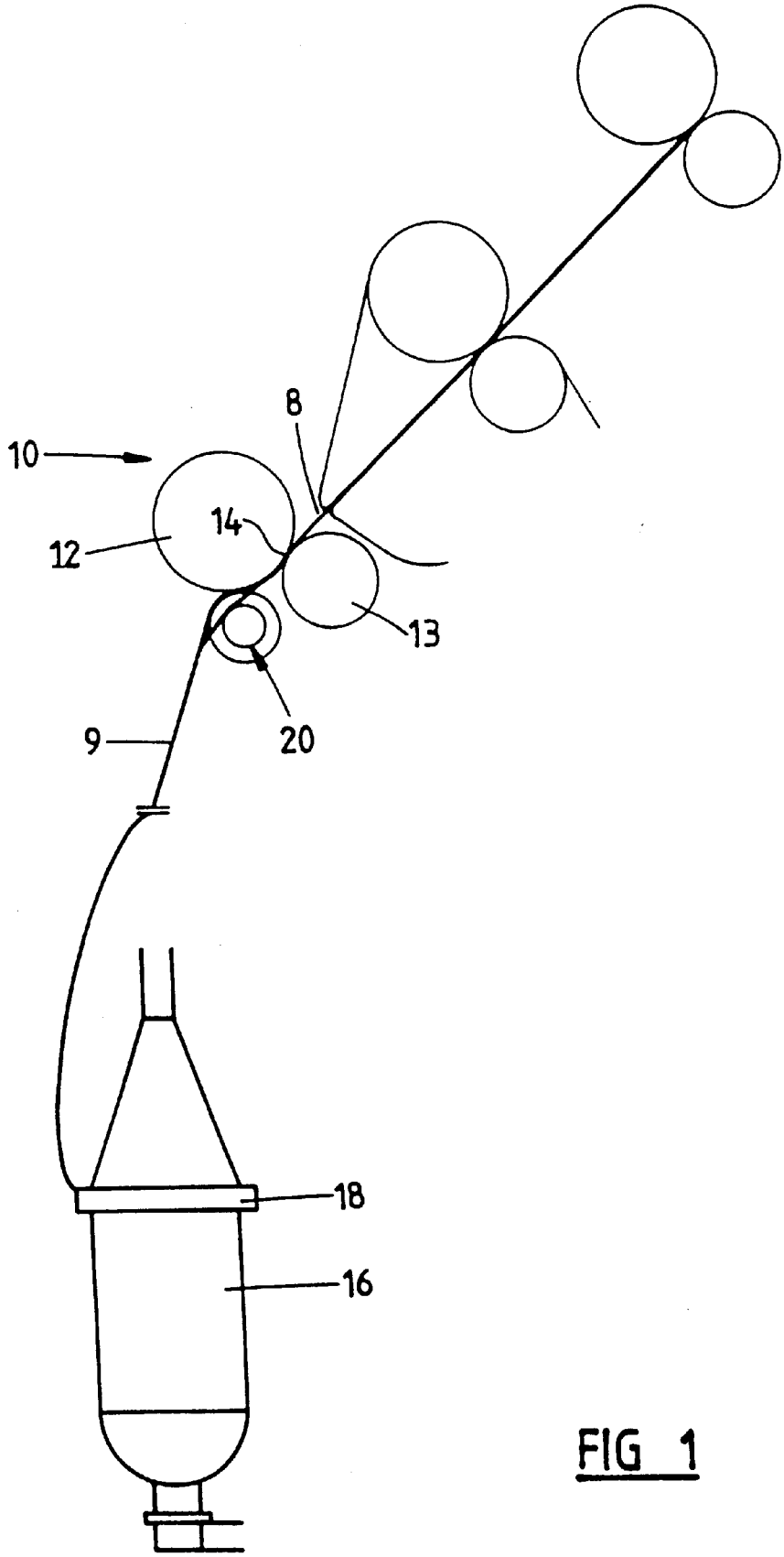
FIG. 1 is a side diagrammatic view of a spinning apparatus in accordance with an embodiment of the invention.
Figure 2:
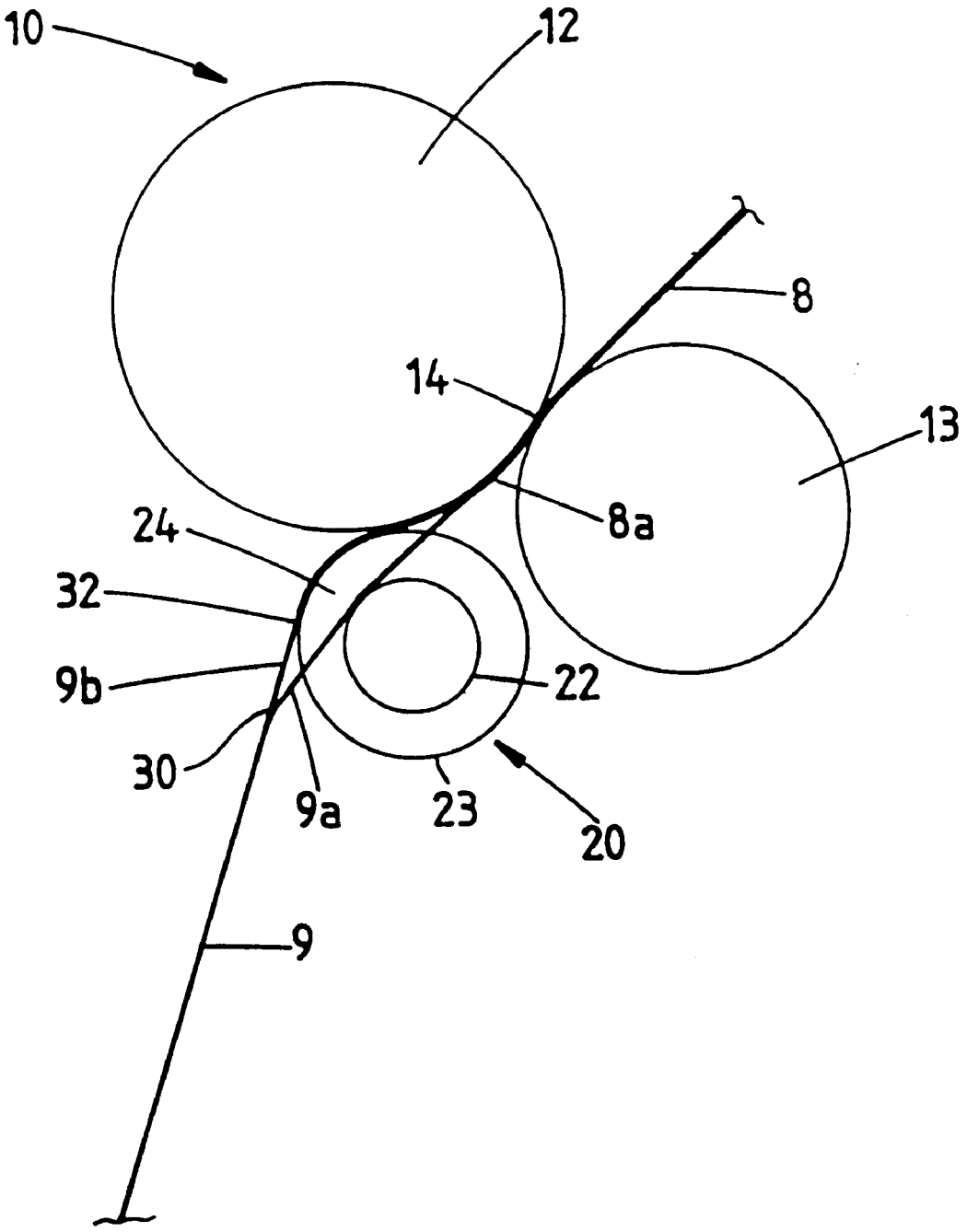
FIG. 2 is an enlargement of part of FIG. 1.
Figure 3:
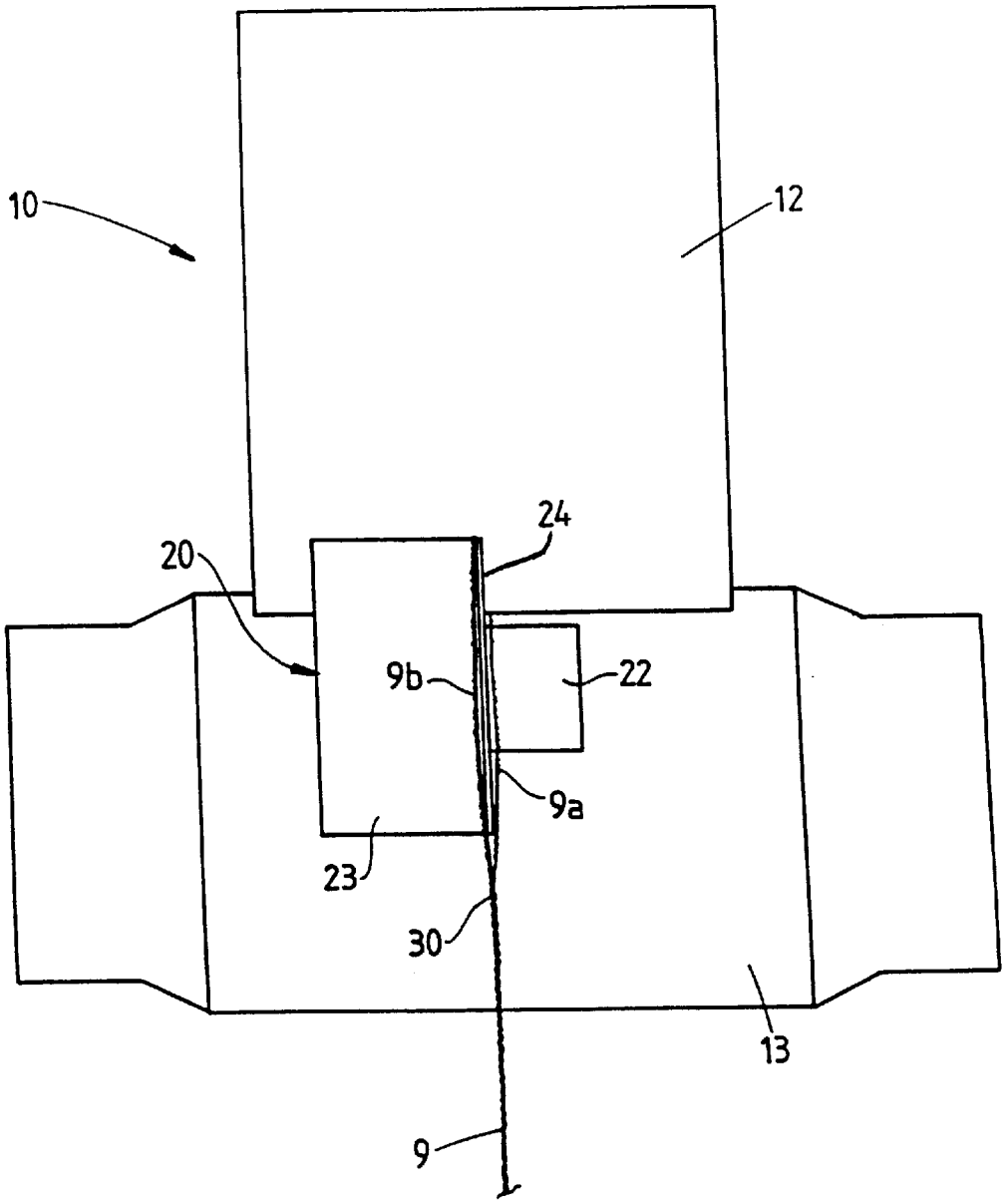
FIG. 3 is a plan view of the apparatus depicted in FIG. 1.

FIGS. 1 to 3 depict the final drafting section 10 of a worsted spinning frame which is conventional to the extent that it includes a front pair of top 12 and bottom 13 drafting rollers defining a drafting nip 14 to which is fed a staple fibre assembly in the form of a drafted roving 8. The drafted assembly, yarn 9, is drawn onto a rotating take-up package 16 centered in a ring assembly 18. The yarn passes through a freely rotating traveller on the ring. The rotation of the package 16, causing the yarn to move the traveller around the ring, provides the means to insert twist into the yarn and wind it into the package. The ring spinner cyclically traverses the package 16 in the usual manner.

Mounted in driving contact with the top front drafting roller 12 is a splitting roller 20. Roller 20 is fitted in end-bearings (not shown), and includes two axially adjacent coaxial cylindrical lands 22, 23. The boundary between the two lands is an annular shoulder 24 which lies in a plane normal to the axis of roller 20. Larger diameter land 23 is in frictional drive contact with drafting roller 12. Shoulder 24 is positioned to be aligned approximately with the centre line of the fibre assembly 8*a* emerging from nip 14. The fibre assembly 8*a* is thereby split or divided into two distinct fibre sub-assemblies or strands 9*a*, 9*b*, which traverse different paths about cylindrical roller lands 22, 23 and then recombine at convergence point 30, where the strands are twisted together to form yarn 9.

The paths traversed by strands 9*a*, 9*b* are of different length: lower strand 9*a* traverses a shorter path and touches smaller-diameter roller land 22 over a shorter contact distance than in the case of upper strand 9*b*, in contact with land 23. It is observed that the twist travels back along upper strand 9*b* past convergence point 30 substantially only to the contact point 32 with roller land 23, whereas the twist in strand 9*a* travels back nearly to nip 14.

Because not all the fibres are either straight or parallel to the direction of travel as they emerge from the front roller nip 14, a proportion of fibres bridge the two strands. Since twist appears to be propagated almost to the front drafting roller nip 14 in the lower split strand 9*a*, the bridging fibres appear to be wrapped around this strand as the assembly moves forward. As the split fibre strands move forward and converge, the fibres which bridge the two strands transfer from one or other strand across shoulder 24 and are wound around the strands such that their slack is taken up. Hence, these fibres for part of their length are incorporated onto or into the lower strand and part into the upper strand. In addition, these sections of the bridging fibres are wrapped or twisted around one or both strands at a different and probably higher helix angle than the twist which is propagating into the strands from the formed yarn. Hence, these fibres experience an enhanced form of fibre migration and entrapment.

As the upper split fibre strand 9*b* is transported around by the larger circumference land 23 of the splitting roller 20 to where twist formation commences, trailing fibre ends also appear to be twisted into the main fibre assembly 9 before the convergence point 30 of the two strands 9*a*, 9*b*. Because the lower split fibre strand 9*a* describes a shorter path length from the nip of the front drafting rollers to the convergence point 30, the tension in the fibres which join this strand is lower than in the upper strand 9*b*. Consequently, when the fibre strands are twisted together at convergence point 30, more fibres may be twisted around the lower fibre strand than around the upper fibre strand. The result is that there will be a much larger spread of helix angles of fibres in the resulting yarn than for conventional singles yarns. This wrapping effect both for fibres and for larger components of the yarn, will result in differential unwrapping, or release of length, when the yarns are effectively untwisted in a plying operation. The result may enhance bulk. The action of splitting the emerging fibre strand narrows the individual ribbon widths of the sub-assemblies, affording better incorporation of the fibres at the outer edges of the fibre strand as it emerges from the nip 14 of the front drafting rollers.

The mechanisms of fibre strand splitting and differential path lengths for fibres which slip over the edges from the larger circumference 23 to the smaller circumference 22 of the splitting roller 20, and hence differing fibre tensions, offers enhanced fibre migration and fibre entrapment The resulting yarns are thus potentially more abrasion resistant, providing potential as weavable singles yarns and lower pilling propensity in knitted structures. It is found that weavable singles yarns made in accordance with this embodiment of the invention can be as few as 50, or even less, fibres on average in cross-section. The tension differential during yarn formation may also result in enhanced yarn bulk when the yarns are plied.

Figure 4:
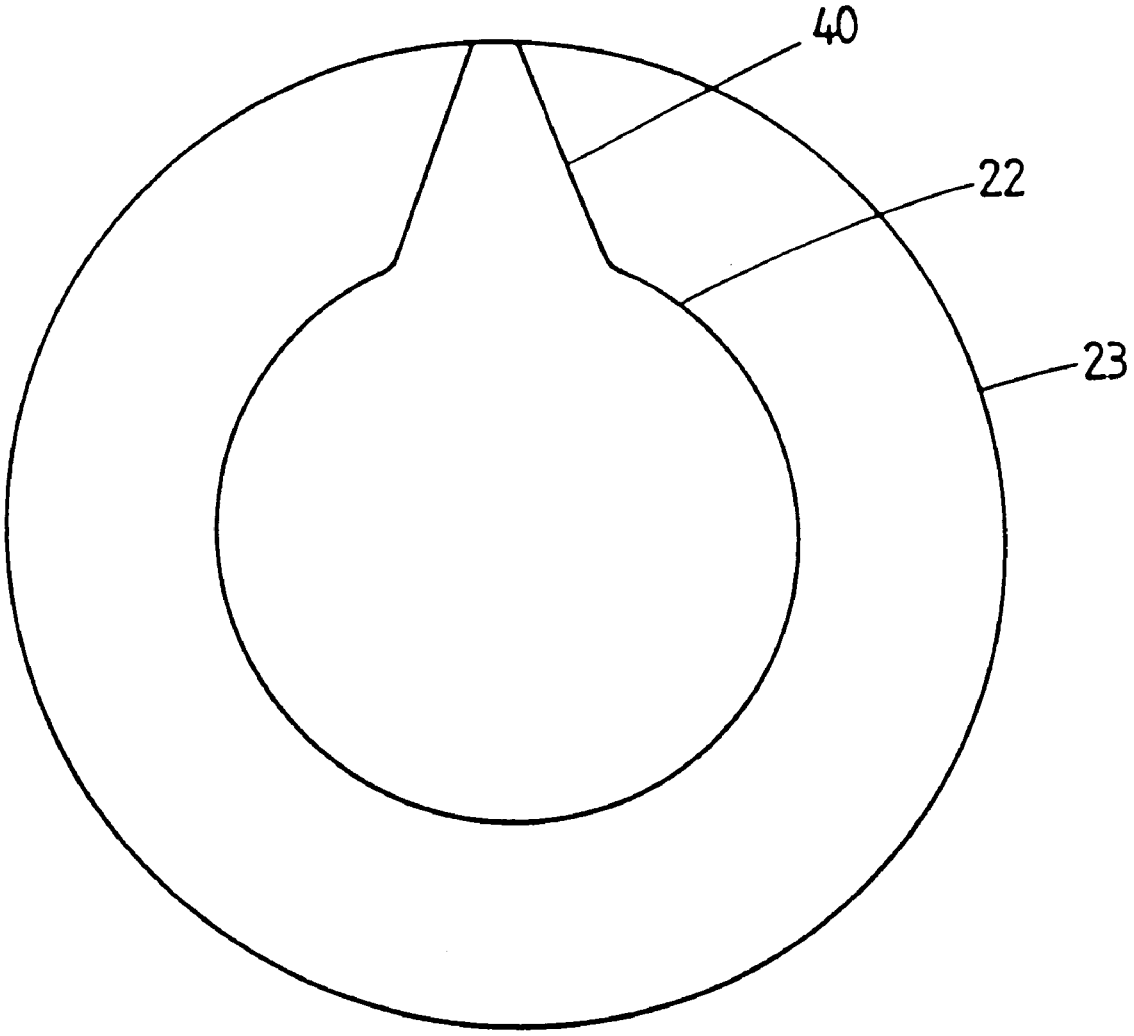
FIG. 4 shows an alternative form of the splitting roller forming part of the apparatus of FIGS. 1 to 3.

The splitting roller 20 depicted in the embodiment of FIGS. 1 to 3 requires centering with the travelling fibre assembly 8*a* emerging from the front drafting rollers 12, 13 and does not allow for strand traversing which is normal on standard spinning frames to minimise top roller wear. To reduce the possibility of the whole fibre strand following the same path along the side of the splitting roller design in FIG. 2, ie over the smaller diameter and thus the shortest path length, a 1 mm, full width land 40 may be incorporated to assist in resplitting the fibre assembly (FIG. 4).

FIGS. 5 and 6 show another alternative method of maintaining the split The two cam-type surfaces 22', 23' induce the fibre assembly to split down the right then left side of the centre every half revolution of the splitting roller 20'. These surfaces 22',23' thus cause a cyclic alteration of the relative positions of the sub-assemblies 9*a*,9*b*.

Figure 7:
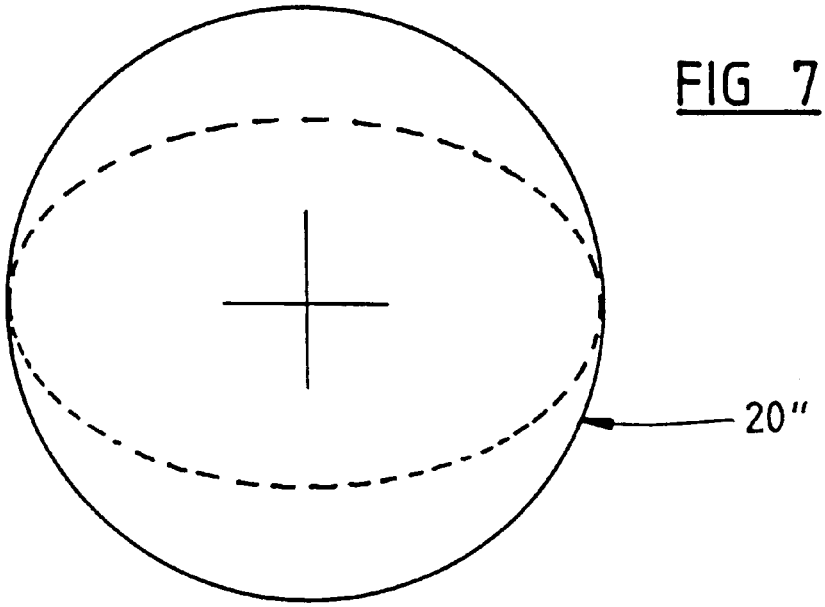
FIGS. 7 and 8 are diagrammatic side and plan views of another form of splitting roller which is less dependent on an accurate setting with reference to the travelling fibre assembly emerging from the drafting nip.
Figure 8:
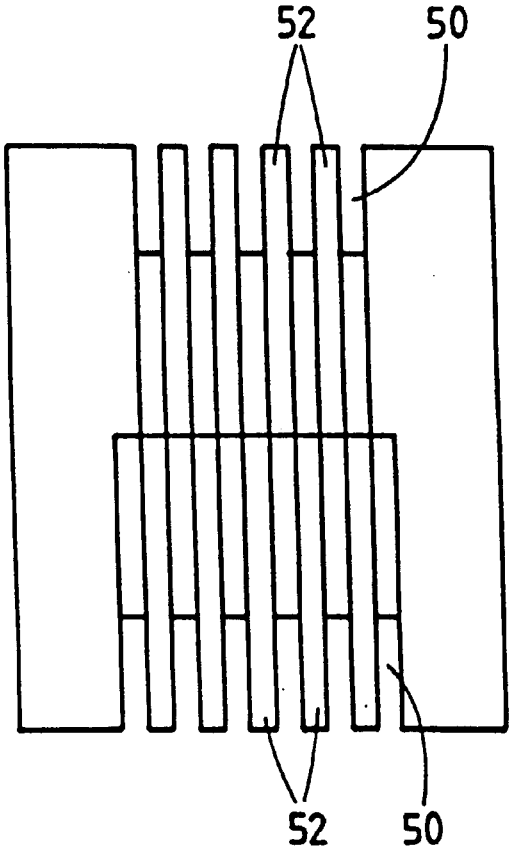

The strand splitting roller 20" shown in FIGS. 7 and 8 are designed to obviate the need to centre the roller and to allow for fibre strand traversal. Each groove (50) and land (52) pair act according to the same principle as the roller design in FIGS. 5 and 6. The groove and land widths on this roller are, for example, 1 mm, however, subsequent observation has shown that it may be beneficial to reduce these dimensions, ie a larger number of grooves and lands per unit width of the splitting roller, particularly when the fibre strand width is narrower, ie when the yarn being formed is finer. The frequency with which the fibre assembly is cyclically split from one side to the other may be increased from every half revolution of the splitting roller as described above, to every quarter revolution or less. Cam-type arrangements may possibly be dispensed with altogether if the groove and land widths are of the order of tens or hundreds of micrometers wide. The grooves and lands in the latter case may be manufactured from a series of discs of fixed or varying alternating diameters.

As mentioned, the action of the multi-cam splitting roller 20" in FIGS. 7 and 8 is similar to that described above in connection with the simple splitting roller 20. For a 40 tex worsted yarn, by way of example, the fibre assembly emergent from the drafting nip is observed to split quite frequently into three strands. One strand follows the longer path length with the other two following the shorter path lengths in the grooves. When spinning a finer yarn count, the assembly generally splits into two sections. Multiple strand splitting may offer improved fibre migration and entrapment with the use of narrower groove and land widths.

The splitting rollers of FIGS. 5 and 7 are also effective to cyclically alter the relative path lengths. traversed by the strands 9*a*, 9*b*, to alter their relative positions and to alter the length of strand into which twist may propagate, and thereby to cyclically alter the relative twist in the strands upstream of convergence point 30. Observation of a high speed video of the device in FIG. 5 spinning two strands, showed that, alternately, more twist was propagated into one strand and then into the other after each change over. The strand with the lower twist, which was also the strand on the lower portion during each cycle, appeared to wrap around the strand with the higher twist. This mechanism appears to trap significant levels of strand twist in the individual strands.

Figure 10:
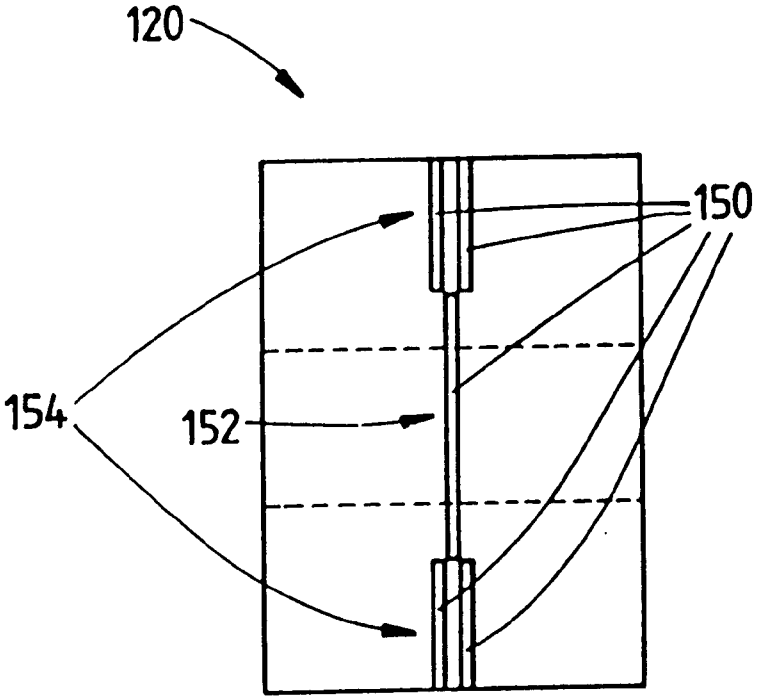
FIGS. 9 and 10 depict, in diagrammatic side and plan views respectively, a modified form of the splitting roller shown in FIGS. 7 and 8, for effecting a "false-braiding" technique according to a further embodiment of the invention.
Figure 9:
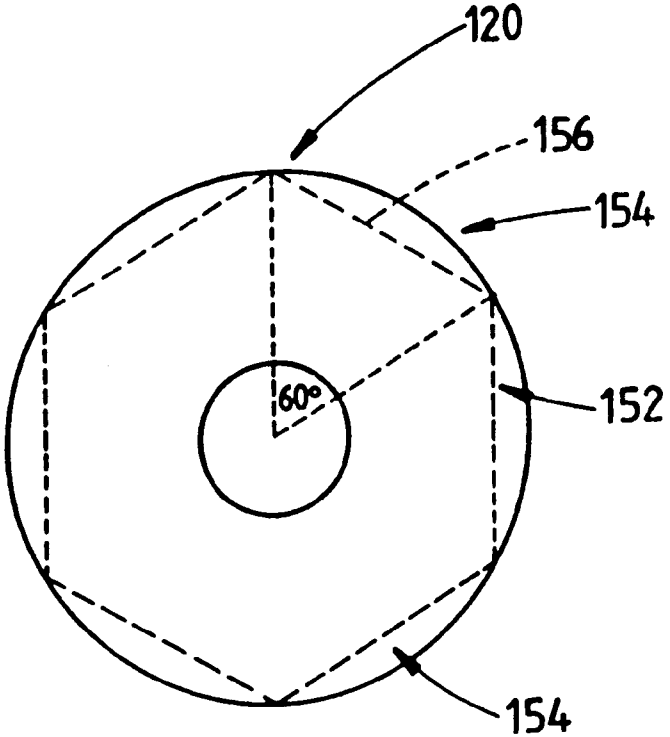

A modified form of the strand splitting roller 20" of FIGS. 7 and 8 is illustrated at 120 in FIGS. 9 and 10. This roller is suitable for effecting a "false braiding" technique. Roller 120 has a configuration of grooves 150 arranged as alternating sections of single and double grooves 152,154 around the circumference. The grooves alternately change the positions of respective outer and central sections or fibre assemblies of an emerging fibre ribbon. Effective entrapment of a fibre within the yarn requires that a fibre experiences several trapping points along its length. The roller circumference is divided into six sections (three double groove sections alternating with three single groove sections), for example each of 15 mm to achieve approximately four points along an average fibre length of 60 mm at which the central sub-assembly is trapped between the other two. The dashed lines 156 in the side view of FIG. 9 indicate how the grooves are cut into the roller attachments. The length of each cut in this case subtends 60° of arc, which in a typical and practical case is approximately equivalent to 15 mm of circumference.

More complex false-braiding designs are also envisaged. The designs varying according to whether the fibre ribbon is deliberately spit into three, four or more sub-assemblies. For three sub-assemblies, which will be referred to here for convenience as strands, a variation may start with the two left-hand strands lowered, followed by raising the central strand (left-hand lowered, 2 right-hand raised), raising the left-hand strand and simultaneously lowering the right-hand stand (2 left-hand raised, right-hand lowered), finally lowering the central strand (left-hand raised, 2 right-hand lowered) before repeating. The position of the strand are thus varied over time.

The roller attachment shown in FIGS. 9 and 10 requires that the groove sections always be aligned with the emerging fibre ribbon. To even out the wear of the top drafting rollers, on most spinning frames the roving from which the fibre ribbons are drafted is slowly traversed sideways back and forth. It would be difficult, or at the least make the whole arrangement rather complex, to make the roller attachment traverse to maintain alignment with the roving. Therefore, to overcome alignment problems, in practice there may be a series of similar groove configurations along the width of the roller attachments, along the lines of that shown in FIG. 8.

Figure 11:
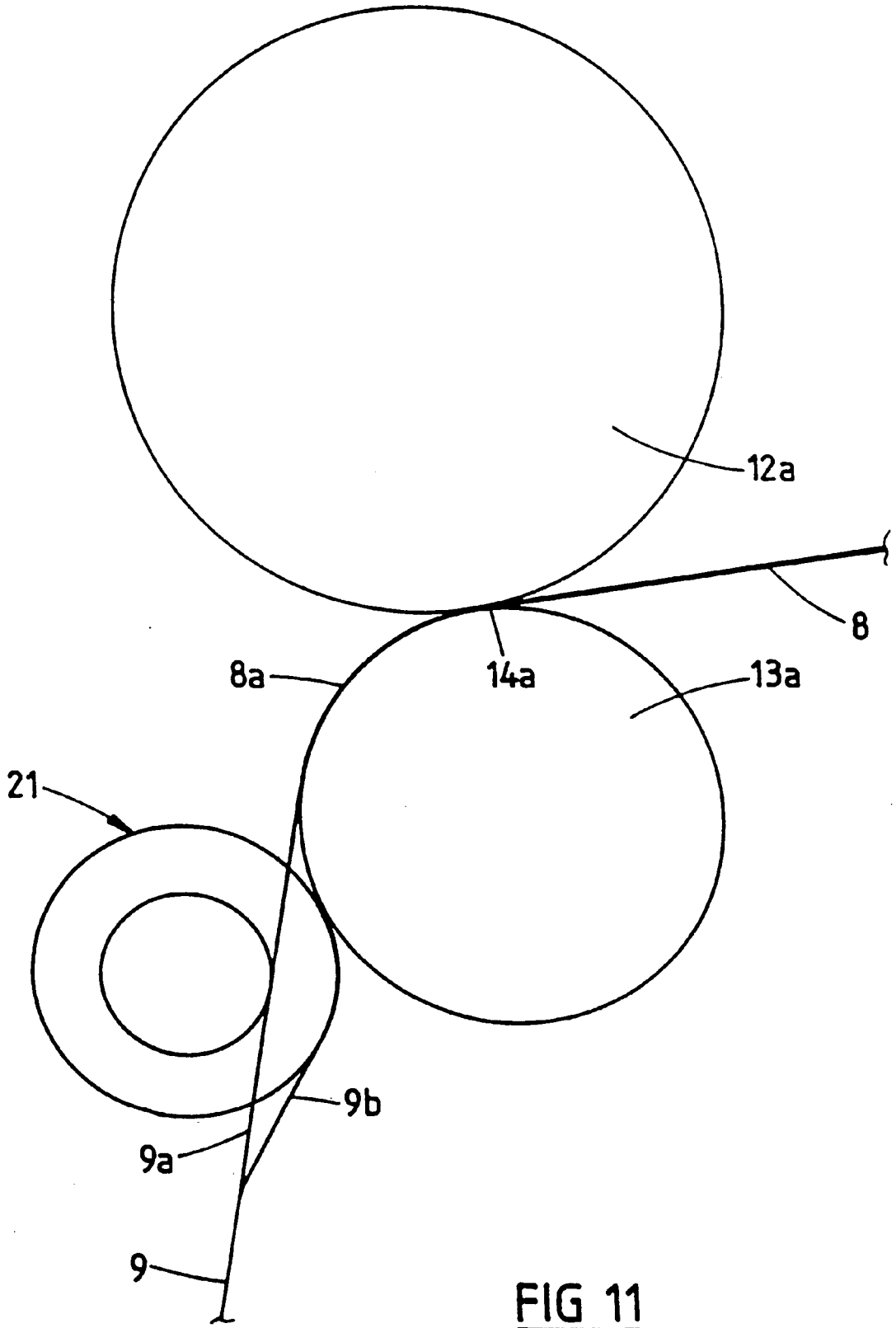
FIG. 11 is a view similar to FIG. 2 of an alternative configuration of the embodiment of FIGS. 1 to 3.

The splitting roller 20 is depicted in FIGS. 1 to 3 in contact with the top drafting roller 12 of the spinning frame. This makes for easier observation of the yarn forming mechanism since it occurs at the front of the splitting roller. However it has been found that the same mechanism occurs when the splitting roller 21 is mounted on the bottom front drafting roller 13*a*, as shown in FIG. 11. Repositioning the spinning frame suction tubes below the splitting rollers, when mounted as in FIGS. 1 and 2, allows piecing up to be easily carried out at spinning start-up or in the event of an end down. This indicates that piecing-up with the splitting rollers mounted against the bottom front drafting roller would also be readily achievable. The other embodiments may also alternatively be mounted on the bottom front drafting roller.

Figure 12:
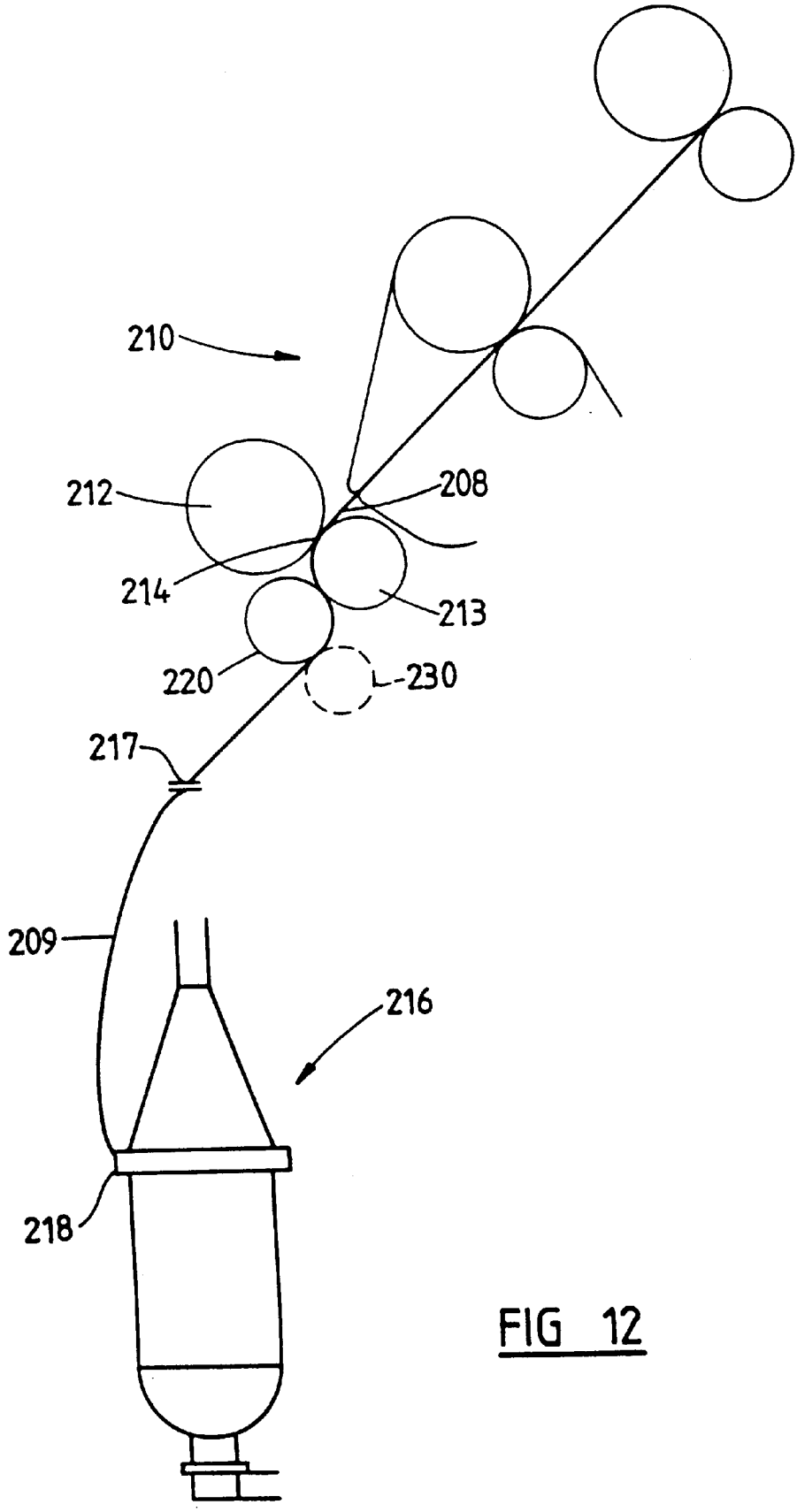
FIG. 12 is a side diagrammatic view of a spinning apparatus in accordance with a still further embodiment of the invention utilising a braiding roller.

FIG. 12 depicts the final drafting section 210 of a worsted spinning frame which is conventional to the extent that it includes a front pair of top 212 and bottom 213 drafting rollers defining a drafting nip 214 to which is fed a staple fibre assembly in the form of a drafted roving or sliver 208. The drafted assembly, yarn 209, is drawn through a guide 217 onto a rotating take-up package 216 centered in a ring assembly 218. The yarn passes through a freely rotating traveller on the ring. The rotation of the package 216, causing the yarn to move the traveller around the ring, provides the means to insert twist into the yarn and wind it into the package. The ring spinner cyclically traverses the package 216 in the usual manner.

Mounted in driving contact with the bottom front drafting roller 213 is a patterned dividing and braiding roller 220. Roller 220 is fitted in end-bearings (not shown), and includes (FIG. 14) two helical grooves 222,223 of opposite hand. Groove 223 is of substantially greater width and depth than groove 223. The grooves are of similar helix angle, and intersect at two cross-overs 225 per revolution. The cross-sectional shape of the grooves, although depicted as arcuate and uniform, is not critical.

Figure 13:
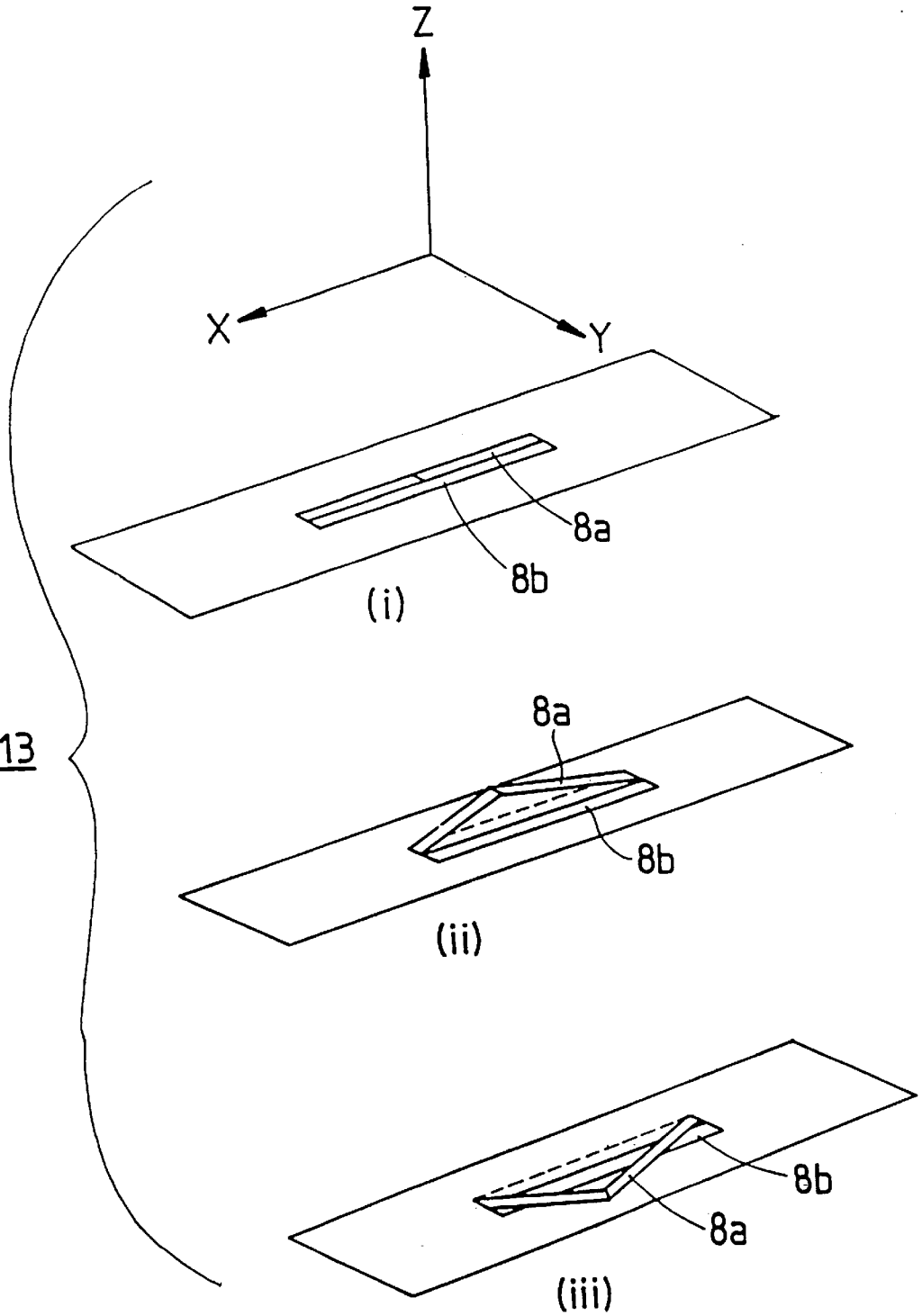
FIG. 13 is a diagram for explaining the concept principle of the embodiment of FIG. 12.

Roller 220 is effective to divide roving 208 into a plurality of fibre sub-assemblies, and to then cyclically vary the paths of these sub-assemblies, and their relative positions, by causing them to interbraid by cyclically laying the sub-assemblies back and forth over each other. The principle involved can be explained as follows, with reference to the diagrams of FIG. 13. Approximating the fibre assembly 208 as a ribbon like structure, for intertwining/braiding, two components of movement are essential to interchange the position of groups or sub-assemblies of fibres in the ribbon. Consider two neighboring groups 8*a*,8*b*, first one group 8*a* must move relative to the other out of the plane of the ribbon (eg in FIG. 13(i) 8*a* is lifted in the Z direction to the position of FIG. 13(ii)) followed by a sideways motion across the ribbon (eg in FIG. 13(ii) 8*a* moves parallel to the Y axis) to interchange their relative position before collapsing the groups back into the plane of the ribbon (FIG. 13(iii)).

With reference now again to FIGS. 12 and 14, during operation, the crossed groove arrangement both naturally divides and spreads the fibre assembly laterally, and the different depths at the cross-over points forces intertwining/braiding of the resultant sub-assemblies. It has been observed that after some initial running, most of the fibre assembly is naturally split and situated in the grooves. Theoretically, during the first revolution, all positions across the incoming fibre "ribbon" assembly will have come in contact with a groove, and due to the geometry they will tend to fall into the groove. Once in the groove the fibre is "trapped" in the groove so that as rotation continues the remaining length of the fibre (and adjacent fibres) are pulled into the groove and thus move sideways with the groove. At the cross-over positions fibres will tend to remain in their existing groove and thus crossover/under a neighboring group.

A roller 230 can be attached as shown, driven by roller 220, to stabilise sideways slipping of the sub-assemblies. It will also be understood that roller 220 can alternatively be driven from the top front roller 212, in which case the geometry is slightly different with the yarn path being over the roller 220 rather than under it.

Other possible configurations of dividing and braiding roller are illustrated in FIGS. 15 to 18. A first alternative is the use of multiple left and right hand helical grooves.

Figure 15:
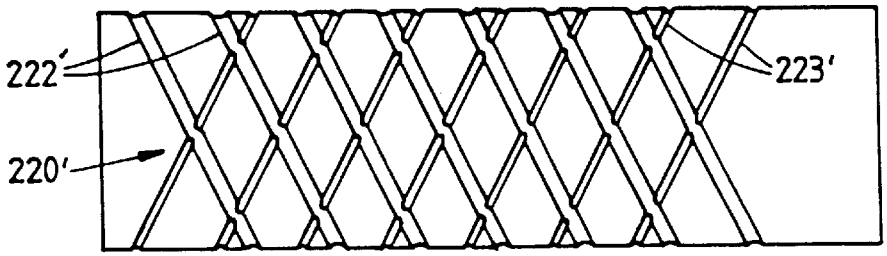

FIG. 15 illustrates an example of a roller 220' with three start left and right hand grooves. Multiple grooves increase the frequency of crossovers per revolution of the roller and hence allow more interactions per unit length of yarn.

Figure 14:
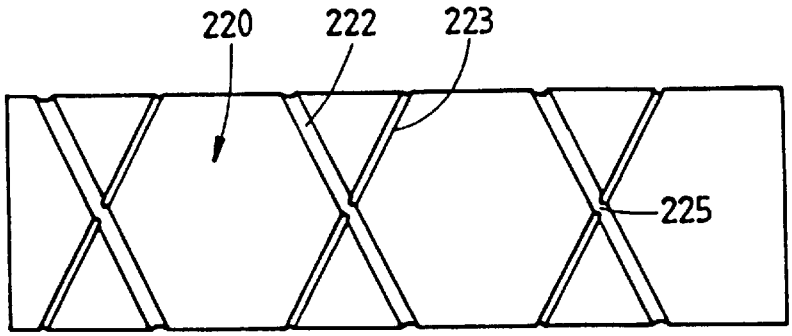
FIGS. 14 to 18 depict alternative configurations of braiding roller for the apparatus of FIG. 12.

At any cross-over point on the roller the relative depth of the two grooves is critical to the resultant braiding sequence. It is known in braiding that the resultant structure is highly dependent on the braiding sequence and that different sequences lead to quite different interactions between the components in the braid. FIGS. 14 and 15 illustrate the simplest case where each groove is at a constant depth. Interaction between sub-assemblies can be increased by altering the depth along a groove so that for example it alternates deep then shallow between successive crossover points. In the simple case of one groove of each hand, ie only two crossovers per revolution, this cyclic depth variation can be readily achieved by cutting at least one of the grooves eccentrically to the axis of the roller.

Figure 16:
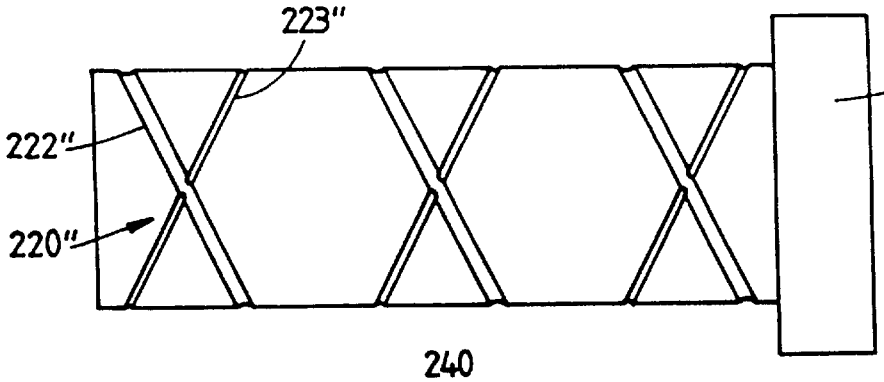

It has been also found that a roller design as shown in FIG. 16 can be advantageous. In this case the roller 220' is driven from the pre-existing front roller of the spinning apparatus by the slightly larger diameter land 221 at one end. This generates a small degree of overfeeding of the incoming sliver onto the grooved roller. This has been unexpectedly found to allow significantly more lateral movement of each sub-assembly (and hence more interactions with other sub-assemblies) before the lateral tension builds up and forces the sub-assembly to jump out into a neighboring groove moving in the opposition direction.

At the cross-over points it has been found that as the lateral tension builds up a strand in a shallow groove sometimes prematurely transfers to the deep groove as the roller rotates. Cutting away an extra section just after the cross-over as shown shaded at 240 in FIG. 17 guides the sub-assembly back into the shallow groove as illustrated.

Figure 17:
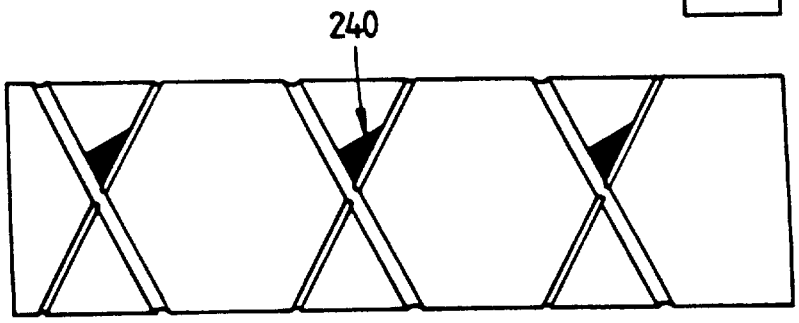
Figure 18:
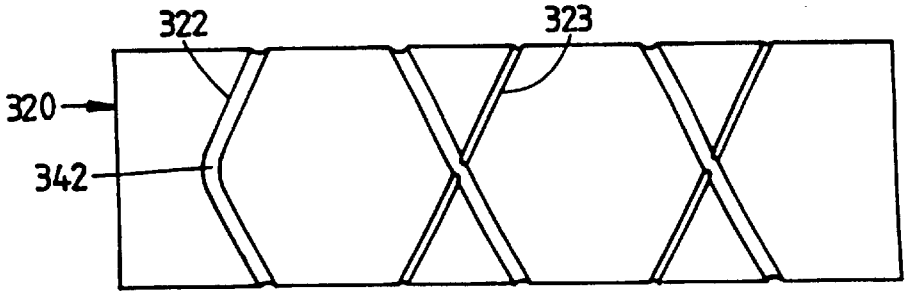
Figure 19:
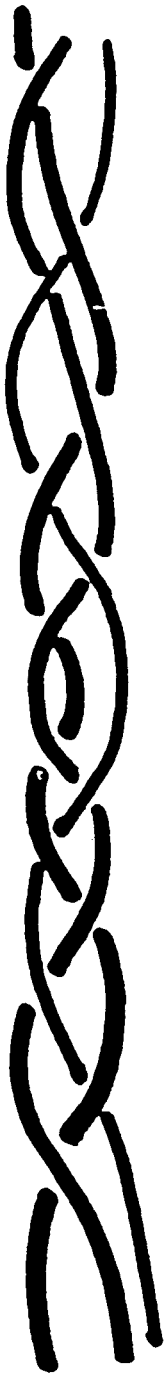
FIG. 19 is a diagram of a braided structure emerging from the nip of a braiding roller of the configuration shown in FIG. 18.

The cross-over design in FIG. 17 is very similar to that commonly used in yarn package winding machines and illustrated at 320 in FIG. 18. Although these designs were developed for feeding a single yarn it has been unexpectedly found that these designs split the fibre assembly and confer a regular braiding pattern to the fibre assembly when utilised as the roller 220 in the apparatus of FIG. 12. Further, at the extremities of the roller, the groove 322 deliberately changes the direction of travel of the fibre group (eg at bend 342) whereas in previous examples this change in direction relies on the tension of the extremities forcing the group into the opposite groove. An example of a three-way divided braided structure produced by the roller of FIG. 18 is depicted in simple diagrammatic form in FIG. 19.

The braiding technique described above with reference to FIGS. 12 to 19 is effective to cause enhanced intermingling of fibres of the overlaid sub-assemblies, and therefore of the fibres in the final spun yarn 209. A usefull level of yarn strength and/or abrasion resistance, relative to the average number of fibres in the yarn cross-section, is achieved The above detailed description has been primarily couched in relation to worsted spinning, but is applicable also to other staple fibres, both natural and man-made. The dimensions of the components, therefore, can be expected to be scaled according to the fibre lengths used. It is also emphasised that, while the described and illustrated embodiments generally involve the division of an initial single fibre assembly, such as drafted roving or silver 8, 208, and recombining the resultant sub-assemblies, the various embodiments may alternatively be applied without such division, ie by drawing in two or more separate sub-assemblies, eg separate rovings or slivers, and combining these to form a yarn.

Throughout this specification and in the accompanying claims, unless the context requires otherwise, the word "comprise", or variations such as "comprises" or "comprising", will be understood to imply the inclusion of a stated integer or group of integers but not the exclusion of any other integer or group of integers.

We claim:

1. Apparatus for spinning yarn comprising:

drafting means for receiving and drafting a travelling fibre assembly;

take-up means for drawing and taking up the fibre assembly from said drafting means:

means for dividing the travelling fibre assembly into a plurality of fibre sub-assemblies downstream of said drafting means and for causing said sub-assemblies to traverse different paths; and means for recombining said fibre sub-assemblies by twisting them together at a point of recombination to form said yarn;

wherein said paths are sufficiently proximate for fibres to continuously transfer from one or more of said sub-assemblies and be drawn onto or into another or other sub-assemblies prior to said point of recombination, so that in the yarn said continuously transferring fibres are incorporated for part of their length onto or into said one or more of said fibre sub-assemblies and for a further part of the length onto or into said another or said other sub-assemblies.

2. Apparatus according to claim 1 wherein said recombining means is effective to twist the sub-assemblies together downstream of said point of recombination such that the twist travels back along each of said fibre sub-assemblies, past said point of recombination, but further back along said one or more of said fibre sub-assemblies than for another fibre sub-assembly.

3. Apparatus according to claim 1 wherein said dividing means includes means for defining paths for the fibre sub-assemblies of different lengths between division of the fibre assembly and said point of recombination, which causes fibres transferring between sub-assemblies to have different axial tensions.

4. Apparatus according to claim 1 wherein said means for dividing the travelling fibre assembly comprises a rotatable roller structure having respective lands either of different displacements or of different radii with reference to an axis of rotation.

5. Apparatus according to claim 4 wherein said rotatable roller structure is arranged to cause cyclic variation of the path lengths traversed by the sub-assemblies.

6. Apparatus according to claim 4, wherein said drafting means includes a first pair of top and bottom drafting rollers, and wherein said rotable roller structure is arranged to be driven by the bottom drafting roller.

7. A method of spinning a yarn comprising the steps of dividing a travelling fibre assembly into a plurality of fibre sub-assemblies, causing the sub-assemblies to traverse different paths and then recombining them by twisting them together at a point of recombination, wherein said paths are sufficiently proximate for fibres to continuously transfer from one or more of said sub-assemblies and be drawn onto or into another or other sub-assemblies prior to said point of recombination so that in the yarn said transferring fibres are incorporated for part of their length onto or into said one or more of said fibre sub-assemblies and for a further part of their length onto or into said another or said other sub-assemblies.

8. A method according to claim 7 wherein said twist travels back along each of said fibre sub-assemblies, past said point of recombination, but further back along said one or more of said fibre sub-assemblies than for another fibre sub-assembly.

9. Apparatus according to claim 7 wherein the fibre sub-assemblies traverse paths of different lengths between division of the fibre assembly and said point of recombination, which causes fibres transferring between sub-assemblies to have different axial tensions.

10. A method according to claim 9 wherein the path lengths traversed by the sub-assemblies are cyclically varied.

11. A method according to claim 7 wherein the fibre assemblies are staple fibre assemblies, natural or man made.

12. A method according to claim 11 wherein the fibre assemblies are wool.

13. Apparatus for spinning a yarn comprising:

means for dividing an initial travelling fibre assembly into a plurality of fibre sub-assemblies;

take-up means for drawing and taking up said plurality of fibre sub-assemblies;

means for causing said sub-assemblies to traverse varying paths that change position over time; and means for combining said fibre sub-assemblies from the causing means to form a fibre assembly comprising said yarn by twisting the sub-assemblies together.

14. Apparatus according to claim 13 further including drafting means for receiving and drafting said initial travelling fibre assembly, said dividing means being disposed downstream of said drafting means.

15. Apparatus according to claim 14 wherein said means for dividing the travelling fibre assembly comprises a rotatable roller structure having respective lands either of different displacements or of different radii with reference to an axis of rotation.

16. Apparatus according to claim 15, wherein said drafting means includes a first pair of top and bottom drafting rollers, and wherein said rotable roller structure is arranged to be driven by the bottom drafting roller.

17. Apparatus according to claim 14, wherein said means for causing said sub-assemblies to traverse varying paths comprises means for varying one or more of the relative positions, lengths, and angles of the paths.

18. Apparatus according to claim 17 wherein said means for dividing the travelling fibre assembly comprises a rotatable roller structure having respective lands either of different displacements or of different radii with reference to an axis of rotation.

19. Apparatus according to claim 18, wherein said drafting means includes a front pair of top and bottom drafting rollers and said rotatable roller structure is arranged to be driven by the bottom drafting roller.

20. Apparatus according to claim 13 wherein said means to cause said sub-assemblies to traverse varying paths comprises means for cyclically interchanging the relative lateral positions of the sub-assemblies.

21. Apparatus according to claim 20 wherein said cyclic interchanging means is effective to lay each sub-assembly across another sub-assembly and then return the former to its original relative lateral position.

22. Apparatus according to claim 20 wherein said cyclic interchanging means is effective to enhance the intermingling of fibres between the sub-assemblies.

23. Apparatus according to claim 20 wherein said cyclic interchanging means is effective to create an intertwined fibre network prior to the insertion of twist.

24. Apparatus according to claim 20 wherein said cyclic interchanging means also serves as said means for dividing the travelling fibre assembly into the plurality of sub-assemblies.

25. Apparatus according to claim 24 wherein said cyclic interchanging means comprises a rotatable roller structure having respective different helical grooves to effect the cyclic variation of the paths traversed by the sub-assemblies.

26. Apparatus according to claim 20, wherein said cyclic interchanging means is effective to form a braided yarn structure.

27. Apparatus according to claim 13 wherein there are three or more fibre sub-assemblies and the relative twist propagation or relative paths is cyclically altered so as to produce a yarn structure in which each fibre sub-assembly is trapped between another two of the fibre sub-assemblies at spaced intervals along the yarn.

28. Apparatus according to claim 13, wherein said means for causing said sub-assemblies to traverse varying paths comprises means for causing said sub-assemblies to traverse cyclically varying paths.

29. A method of spinning a yarn comprising the steps of:

dividing an initial travelling fibre assembly into a plurality of fibre sub-assemblies;

causing said sub-assemblies to traverse varying paths that change position over time; and then combining said fibre sub-assemblies to form a fibre assembly comprising said yarn by twisting the sub-assemblies together.

30. A method according to claim 29, wherein one or more of relative positions, lengths and angles of said paths traversed by the sub-assemblies are cyclically varied.

31. A method according to claim 29 wherein the paths of the sub-assemblies are cyclically varied by cyclically interchanging the relative lateral positions of the sub-assemblies.

32. A method according to claim 31 wherein each sub-assembly is laid across another sub-assembly and then returned to its original relative lateral position.

33. A method according to claim 31 wherein the interchanging is controlled according to a pre-determined sequence along the length of the moving fibre assembly selected to optimise fibre interactions.

34. A method according to claim 31 wherein the interchanging is effective to create an intertwined fibre network prior to the insertion of twist.

35. A method according to claim 31, wherein said cyclic interchanging is effective to form a braided structure.

36. A method according to claim 29 wherein there are three or more fibre sub-assemblies and the relative twist propagation or relative paths is cyclically altered so as to produce a yarn structure in which each fibre sub-assembly is trapped between another two of the fibre sub-assemblies at spaced intervals along the yarn.

37. A method according to claim 29, comprising the further step of cyclically varying the paths traversed by the sub-assemblies.

38. A method for forming a yarn comprising twisting a plurality of fibre sub-assemblies together at a convergence point to form a fibre assembly being said yarn, and further including cyclically altering one or more of the relative twist propagation and the relative tension in the sub-assemblies upstream of the convergence point.

39. A method according to claim 38 wherein said cyclic alteration of the relative twist propagations is effected by cyclically altering one or more of: the distance between last surface contact or nip point of the sub-assemblies and their convergence, the relative positions of the sub-assemblies, and the path length of the sub-assemblies before their convergence.

40. Apparatus for forming a yarn comprising means for twisting a plurality of fibre sub-assemblies together at a convergence point to form a fibre assembly being said yarn, and further including means for cyclically altering one or more of the relative twist propagation and the relative tension in the sub-assemblies upstream of the convergence point.

41. Apparatus according to claim 40, further including means for dividing an initial travelling fibre assembly into said plurality of fibre sub-assemblies.

42. Apparatus according to claim 41, further including drafting means for receiving and drafting said initial travelling fibre assembly, said dividing means being disposed downstream of said drafting means.

43. Apparatus according to claim 42 wherein said means for cyclically altering the relative twist propagation comprises means for cyclically altering one or more of: the distance between last surface contact or nip point of the sub-assemblies and their convergence, the relative positions of the sub-assemblies, and the path length of the sub-assemblies before their convergence.

44. Apparatus according to claim 43 wherein said means to cyclically alter the relative twist propagation comprises a rotatable roller structure having respective lands of different displacements or of different radii or both with reference to an axis of rotation.

45. Apparatus according to claim 42, wherein said means to cyclically alter the relative twist propagation comprises a rotatable roller structure having respective lands of different displacements or of different radii or both with reference to an axis of rotation.

46. Apparatus according to claim 45 wherein said drafting means includes a front pair of top and bottom drafting rollers and said rotatable roller structure is arranged to be driven by the bottom drafting roller.

47. Apparatus according to claim 45, wherein said drafting means comprises a front pair of top and bottom drafting rollers and said rotatable roller structure is arranged to be driven by the bottom drafting roller.

48. Apparatus for spinning yarn, comprising:

take-up means for drawing and taking up a plurality of fibre sub-assemblies with each sub-assembly containing a plurality of fibres;

means for combining said fibre sub-assemblies at a convergence point to form a fibre assembly comprising said yarn by twisting the sub-assemblies together;

means for engaging one or more of said sub-assemblies upstream of the convergence point to cause them to traverse varying paths prior to said combining; and means for dividing an initial travelling fibre assembly into said plurality of fibre sub-assemblies.

49. Apparatus according to claim 48 further including drafting means for receiving and drafting said initial travelling fibre assembly, said dividing means being disposed downstream of said drafting means.

50. Apparatus according to claim 48 wherein said means for dividing the travelling fibre assembly comprises a rotatable roller structure having respective lands of either different displacements or different radii with reference to an axis of rotation.

51. Apparatus according to claim 48 wherein said varying paths are cyclically varying paths.

52. Apparatus according to claim 48 wherein said engaging means to cause said sub-assemblies to traverse varying paths comprises means for cyclically interchanging the relative lateral positions of the sub-assemblies.

53. Apparatus according to claim 52, wherein said cyclic interchanging means is effective to lay each sub-assembly across another sub-assembly and then return the former to its original relative lateral position.

54. Apparatus according to claim 52, wherein said cyclic interchanging means is effective to enhance the intermingling of fibres between the sub-assemblies.

55. Apparatus according to claim 52, wherein said cyclic interchanging means is effective to create an intertwined fibre network prior to the insertion of twist.

56. Apparatus according to claim 52, wherein said cyclic interchanging means also serves as said means for dividing the travelling fibre assembly into the plurality of sub-assemblies.

57. Apparatus according to claim 56, wherein said cyclic interchanging means comprises a rotatable roller structure having respective different helical grooves to effect the cyclic variations of the paths traversed by the sub-assemblies.

58. Apparatus according to claim 52, wherein said cyclic interchanging means is effective to form a braided yarn structure.

59. A method of spinning a yarn comprising combining a plurality of fibre sub-assemblies at a convergence point to form a fibre assembly comprising said yarn by twisting the sub-assemblies together, and engaging one or more of said sub-assemblies upstream of the convergence point to cause them to traverse varying paths prior to said combining step, each of said sub-assemblies containing a plurality of fibres, and dividing an initial travelling fibre assembly into said plurality of fibre sub-assemblies before the combining step.

60. A method of spinning a yarn comprising combining a plurality of fibre sub-assemblies at a convergence point to form a fibre assembly comprising said yarn by twisting the sub-assemblies together, and engaging one or more of said sub-assemblies upstream of the convergence point to cause them to traverse varying paths prior to said combining step, each of said sub-assemblies containing a plurality of fibres, wherein the fibre sub-assemblies traverse paths of different lengths between said engaging step and combining step.

61. A method according to claim 60, wherein the path lengths traversed by the sub-assemblies are varied.

62. A method according to claim 61, wherein said varying paths are cyclically varying paths.

63. A method according to claim 62, wherein the paths of the sub-assemblies arc cyclically varied by cyclically interchanging the relative lateral positions of the sub-assemblies.

64. A method according to claim 63 wherein each sub-assembly is laid across another sub-assembly and then returned to its original relative lateral position.

65. A method according to claim 63 wherein said interchanging is controlled according to a predetermined sequence along the length of the moving fibre assembly selected to optimize fibre interactions.

66. A method according to claim 63, wherein said interchanging is effective to create an intertwined fibre network prior to the insertion of twist.

67. A method according to claim 63, wherein said cyclic interchanging is effective to form a braided structure.

68. A method of spinning a yarn comprising the steps of combining a plurality of fibre sub-assemblies at a convergence point to form a fibre assembly comprising said yarn by twisting the sub-assemblies together, and engaging one or more of said sub-assemblies upstream of the convergence point to cause them to traverse varying paths prior to said combining step, each of said sub-assemblies containing a plurality of fibres, and wherein the path lengths traversed by the sub-assemblies are varied.

* * * * *